US006616087B1

(12) United States Patent
Chern

(10) Patent No.: US 6,616,087 B1
(45) Date of Patent: Sep. 9, 2003

(54) ROTARY TAPE DISPENSER

(76) Inventor: Shyue Jinn Chern, No. 23-3, Lin 5, Taiping Tsuen, Linkou Shiang, Taipei (TW)

( * ) Notice: Subject to any disclaimer, the term of this patent is extended or adjusted under 35 U.S.C. 154(b) by 0 days.

(21) Appl. No.: 10/202,876

(22) Filed: Jul. 26, 2002

(51) Int. Cl.[7] ..... B65H 19/00; B65H 35/10

(52) U.S. Cl. ..... 242/559.2; 242/559.1; 242/588.6; 225/34; 225/35

(58) Field of Search ..... 242/559.2, 559.1, 242/588.6; 225/34, 35, 45, 46, 52

(56) References Cited

U.S. PATENT DOCUMENTS 2,456,660 A * 12/1948 Werner ..... 225/35
2,535,621 A * 12/1950 Andrews ..... 225/25
3,373,644 A * 3/1968 Bjelland ..... 83/650
3,768,713 A * 10/1973 Lash ..... 225/34
3,870,211 A * 3/1975 Schriever ..... 225/34
4,108,513 A * 8/1978 Lander ..... 225/34
4,492,138 A * 1/1985 Breuers et al. ..... 83/203
4,557,426 A * 12/1985 Siciliano ..... 242/560.3
4,651,910 A * 3/1987 DeGroot ..... 225/1
4,714,210 A * 12/1987 Howell ..... 242/422.4
4,934,575 A * 6/1990 Mustafa ..... 225/38
5,011,059 A * 4/1991 Jennings et al. ..... 225/35
6,491,251 B1 * 12/2002 Stanland et al. ..... 242/559.2

* cited by examiner

*Primary Examiner*—Donald P. Walsh
*Assistant Examiner*—Jonathan R Miller
(74) *Attorney, Agent, or Firm*—Rabin & Berdo, P.C.

(57) ABSTRACT

A rotary tape dispenser comprises a container including an inlet, an outlet, and a pin; a circular rotary plate having a portion exposed at the inlet and including a center hole, a plurality of cylinders around the center, a plurality of pairs of adjacent guide posts along the periphery wherein the number of the pairs of adjacent guide posts is equal to that of the cylinders, and a central sleeve put on and rotatable about the pin; a plurality of rolls of adhesive tapes wound on the cylinders, each roll having an open end pulled through the gap between the pair of guide posts; and a blade adjacent the outlet. The exposed portion of the rotary plate is counterclockwise rotatable to turn the rolls until one desired roll has turned to a position at the outlet. In response the roll can be pull and cut by the blade.

10 Claims, 5 Drawing Sheets

ROTARY TAPE DISPENSER

BACKGROUND OF THE INVENTION

1. Field of the Invention

The present invention relates to a tape dispenser and more particularly to a rotary tape dispenser with improved characteristics.

2. Description of Related Art

Conventional tape dispensers are generally classified as either portable ones or desktop ones. Typically, there is only one roll of adhesive tape contained in either type of tape dispenser. It is also known that there are a variety of rolls of adhesive tapes having different colors or patterns commercially available. For using different tapes, the user has to buy a number of tape dispensers each for containing a roll of adhesive tape. It is evident that such is not cost effective. Alternatively, the user may buy only one tape dispenser. In use a different type of tape, the user simply replaces the old one contained in the tape dispenser with the different type of tape. However, such is not convenient and time consuming if a frequent replacement is required.

A solution to the above drawback is disclosed in a conventional tape dispenser as shown in FIG. 5. The tape dispenser comprises a parallelepiped container A, a cylinder B projected inwardly from a center of a side of the container A, a plurality of rolls of adhesive tapes (three are shown) C wound side by side on the cylinder B, and a blade D along an edge of the container A. The purpose of such design is to enable the user to use a desired roll of adhesive tape at any time without having to replace one roll of adhesive tape with the other. However, the prior art suffered from several disadvantages. For example, it is simply a combination of three tape dispensers with an enlarged container A, a prolonged cylinder B, and a prolonged blade D. Further, any two adjacent rolls of adhesive tapes C may be somewhat adhered together since the adhesive tape is sticky in nature. This may cause an non-smooth pull of the roll of adhesive tape C since one pull of the desired roll of adhesive tape C may together pull one or two adjacent rolls of adhesive tapes C. To the worse, the rolls of adhesive tapes C may get stuck in the container A. Furthermore, the user has to remove the outer roll of adhesive tape first for replacing the empty intermediate or inner roll of adhesive tape. This is very inconvenient in use.

Thus, it is desirable to provide an improved rotary tape dispenser in order to overcome the above drawbacks of the prior art.

SUMMARY OF THE INVENTION

It is an object of the present invention to provide a rotary tape dispenser comprising a container including a base having an inlet, an outlet, a pin projected inwardly from about a center, and a cover releasably secured to the base; a circular rotary plate having a portion exposed at the inlet and including, at a side facing the cover, a plurality of cylinders around a central hole, and a plurality of pairs of adjacent guide posts along the periphery wherein the number of the pairs of adjacent guide posts is equal to that of the cylinders; a plurality of rolls of adhesive tapes wound on the cylinders, each of the rolls of adhesive tapes having an open end pulled through the gap between each pair of guide posts; and a blade adjacent the outlet; wherein in an operation, rotate the exposed portion of the rotary plate to turn the rolls of adhesive tapes until one of the rolls of adhesive tapes has turned to a position at the outlet and in response pull the roll of adhesive tape out of the outlet prior to being cut by the blade.

In one aspect of the present invention, the container further comprises an axial pawl on the pin and the rotary plate further comprises a central sleeve projected inwardly from the periphery of the central hole, the central sleeve being put on the pin and an axial ratchet member inside the central sleeve engaged with the axial pawl so that the rotary plate is permitted to rotate only counterclockwise.

In another aspect of the present invention, the cylinders are equally spaced apart around the center of the rotary plate.

In still another aspect of the present invention, the rotary plate further comprises a dust wall at the periphery sized to conform to the outlet.

In still another aspect of the present invention, the container further comprises an inwardly projected center sleeve and an axial ratchet member on the inner surface of the center sleeve and the rotary plate further comprises a central cylinder projected inwardly from the periphery of the central hole, and a central pawl extended outwardly from the bottom of the central cylinder engaged with one tooth of the ratchet member and through the center sleeve so that in the operation, counterclockwise rotate the central pawl to turn the rolls of adhesive tapes until one of the rolls of adhesive tapes has turned to a position at the outlet and in response pull the roll of adhesive tape out of the outlet prior to being cut by the blade.

The above and other objects, features and advantages of the present invention will become apparent from the following detailed description taken with the accompanying drawings.

DETAILED DESCRIPTION OF THE PREFERRED EMBODIMENTS

Figure 1:
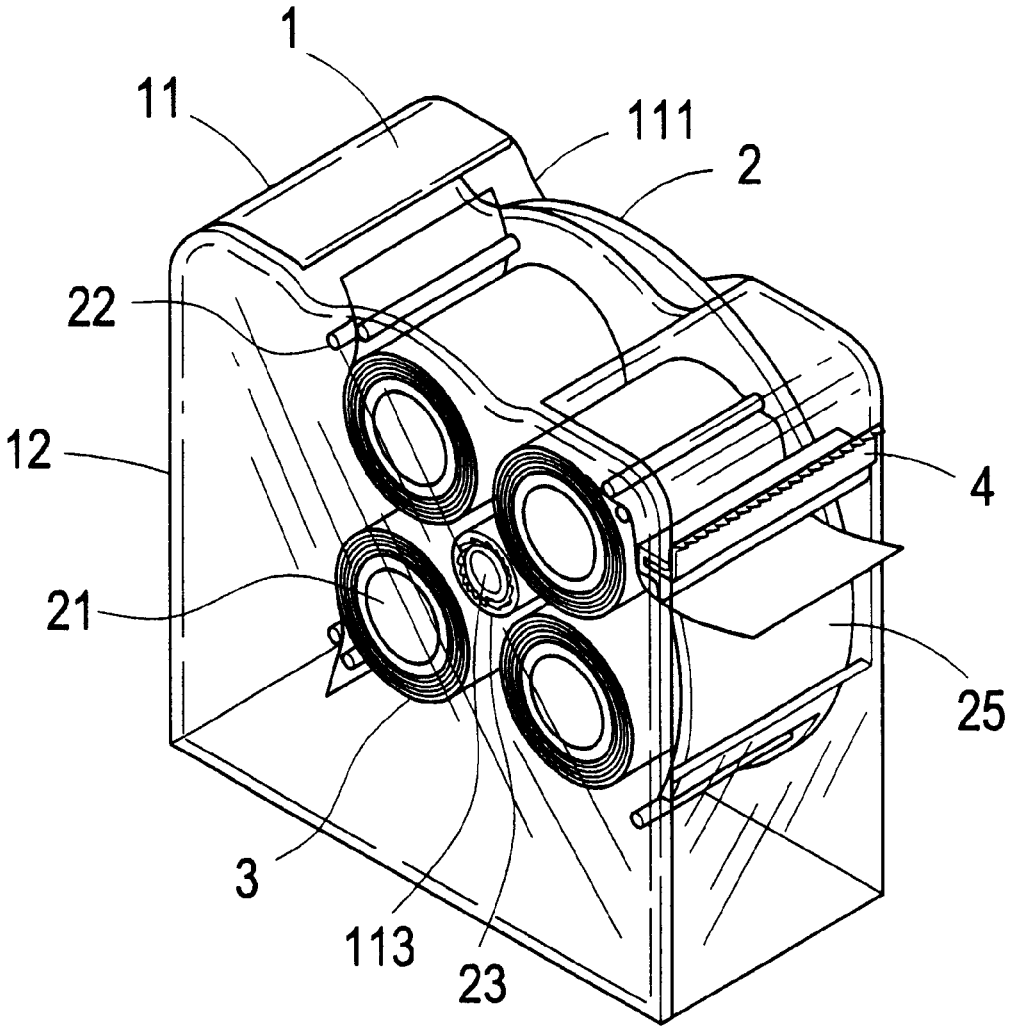
FIG. 1 is a perspective view of a first preferred embodiment of a rotary tape dispenser according to the invention.
Figure 2:
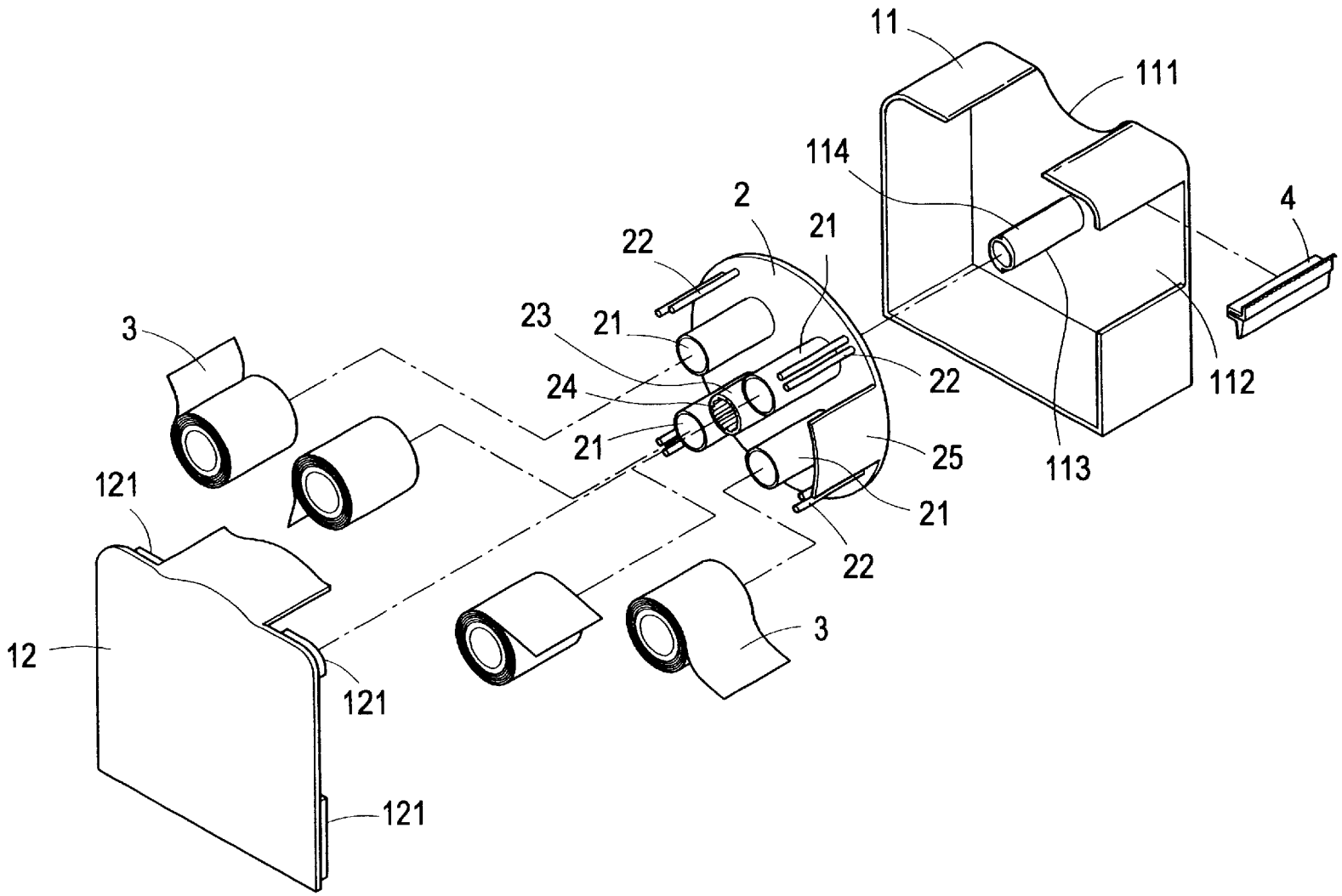
FIG. 2 is an exploded view of the FIG. 1 tape dispenser.

Referring to FIGS. 1 and 2, there is shown a preferred embodiment of a rotary tape dispenser constructed in accordance with the invention. The tape dispenser comprises a substantially parallelepiped container 1 including a base 11 having a concave top inlet 111 at an edge, a side outlet 112, a pin 113 projected inwardly from the bottom of a center hole (not shown), and an axial pawl 114 on the pin 113. A transparent cover 12 includes a plurality of fastening members 121 on the edge for securing to the base 11. A circular rotary plate 2 has a portion exposed at the inlet 111 and a central hole (not shown) and including includes, at a side facing the cover 12, a plurality of cylinders (four are shown in this embodiment) 21 projected inwardly and equally spaced apart around the center of the rotary plate 2, four pairs of adjacent guide posts 22 projected inwardly along the periphery each spaced apart from the corresponding cylinder 21, a dust wall 25 at the periphery sized to conform to the outlet 112, a sleeve 23 projected inwardly from the periphery of the central hole, and an axial ratchet member 24 on the inner surface of the sleeve 23. The ratchet member 24 has a plurality of teeth each having an arcuate long edge and a straight short edge wherein the sleeve 23 is put on and rotatable about the pin 113 with the pawl 114 engaged with one tooth of the ratchet member 24. A plurality of rolls of adhesive tapes (four are shown) 3 are wound on the cylinders 21. Each of the rolls of adhesive tapes 3 has an open end pulled through the gap between each pair of guide posts 22. A blade 4 is on top of an edge of the outlet 112.

Figure 3:
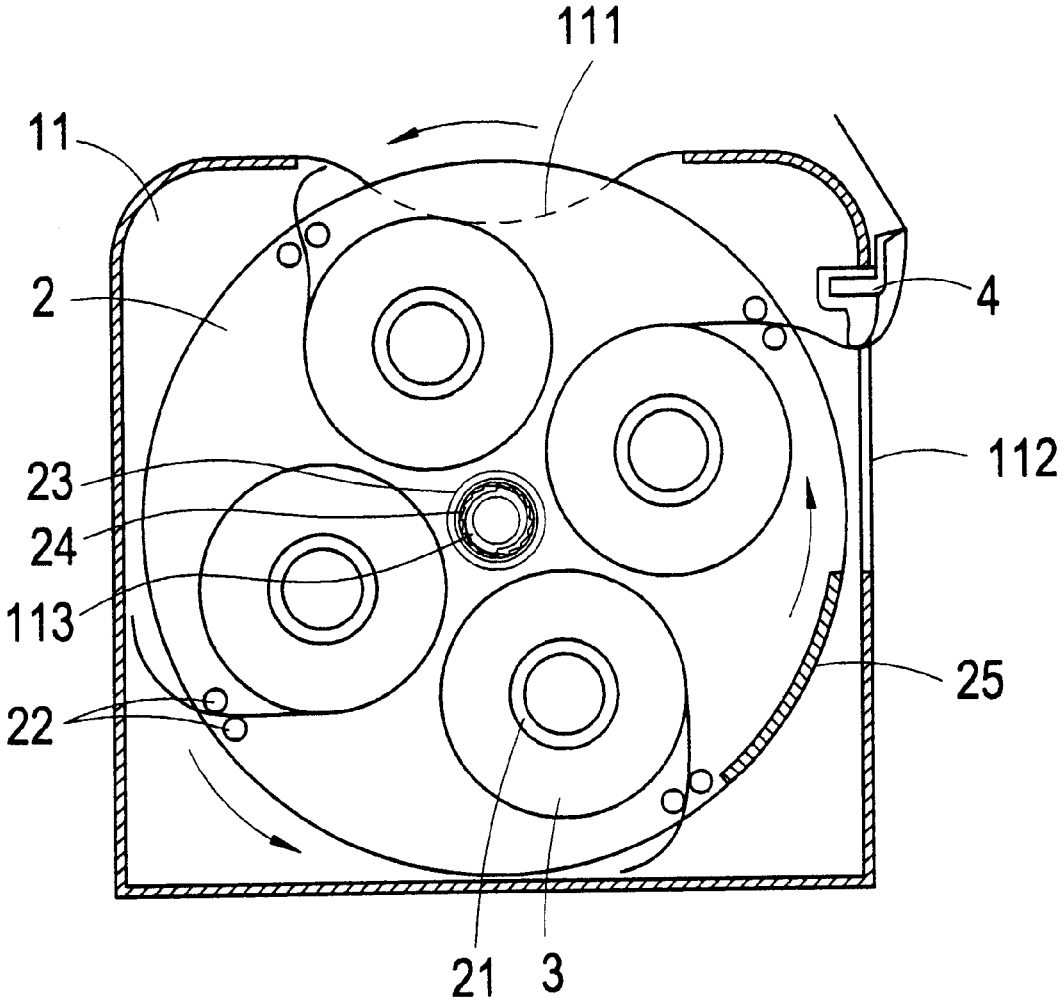
FIG. 3 is a cross-sectional view of the FIG. 1 tape dispenser for illustrating an operation thereof.

Referring to FIG. 3, an operation of the invention will now be described in detail below. First, the exposed portion of the rotary plate 2 at the inlet 111 is rotated counter clockwise to turn the rolls of adhesive tapes 3. The user can stop the rotation after the desired roll of adhesive tape 3 has turned to the position at the outlet 112 by observing the rotation through the cover 12. Once stopped, the user can then pull the roll of adhesive tape 3 out of the outlet 112 a desired length prior to being cut by the blade 4. It is noted that the ratchet member 24 is designed to rotate counterclockwise only. Further, the adhesive side of the roll of adhesive tape 3 faces inward. This can prevent the adhesive from being left on the blade 4 since the cutting of the blade 4 occurs on the opposite side of the roll of adhesive tape 3. This can also prevent the adhesive side of the roll of adhesive tape 3 from contacting and thus sticking to the inner surface of the container 1. Moreover, it is possible to prevent dust or the like from entering the container 1 by disposing the dust wall 25 at the outlet 112 by rotation in an unused state. In addition, in replacement the user simply replaces the empty roll of adhesive tape 3 with a new one by removing the cover 12. Thus, it is very convenient.

Figure 4:
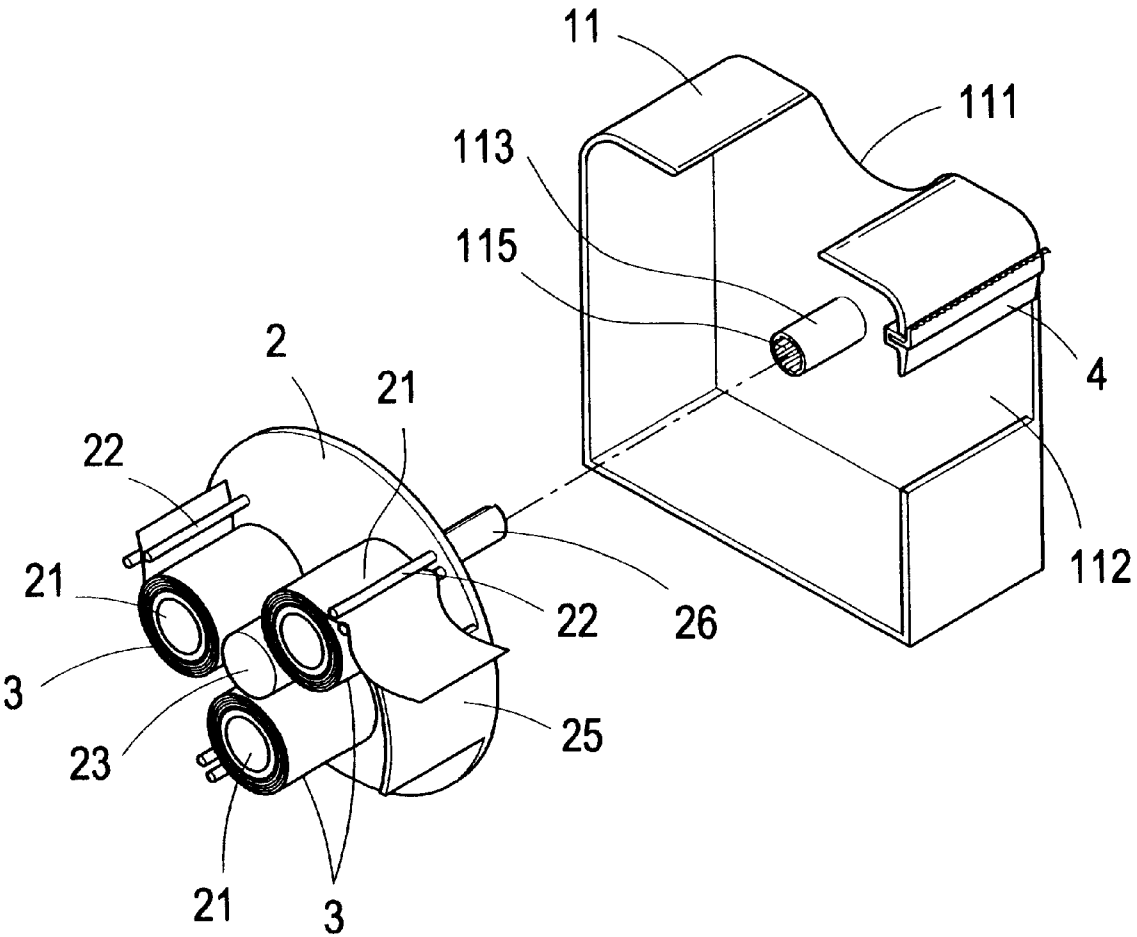
FIG. 4 is a cross-sectional view of a second preferred embodiment of a rotary tape dispenser according to the invention.
Figure 5:
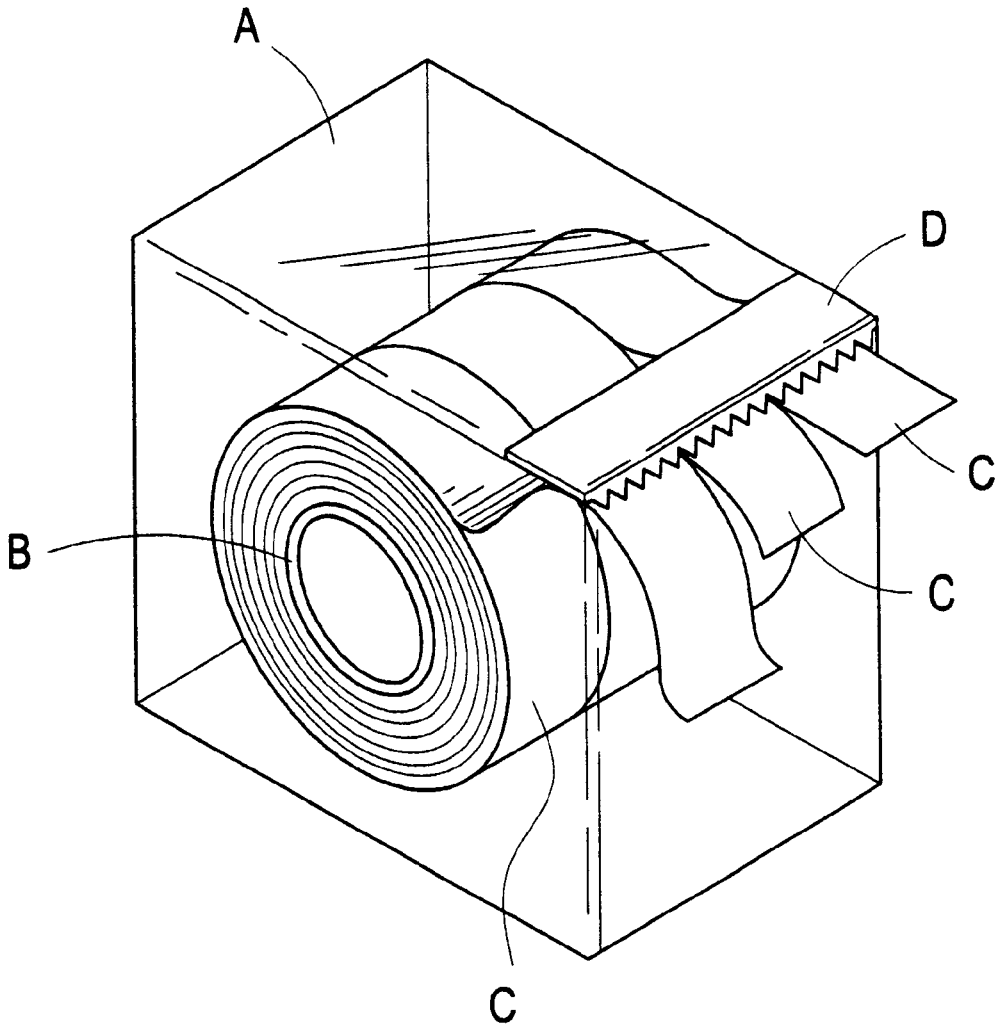
FIG.5 (Prior Art)
FIG. 5 is a perspective view of a conventional tape dispenser.

Referring to FIG. 4, there is shown a second preferred embodiment of a rotary tape dispenser according to the invention. The differences between the first and the second preferred embodiments are the rotary plate 2 and the container 1. As shown, the container 1 comprises a central sleeve 113 projected inwardly from the periphery of the center hole and an axial ratchet member 115 on the inner surface of the sleeve 113

The ratchet member 115 has a plurality of teeth. The rotary plate 2 comprises three cylinders 21, three rolls of adhesive tapes 3, three pairs of adjacent guide posts 22, a central cylinder 23 projected inwardly from the periphery of the central hole, and a central pawl 26 extended outwardly from the bottom of the central cylinder 23 engaged with one tooth of the ratchet member 115 and through the sleeve 113 and the center hole of the base 11 wherein the axial ratchet member 24 in the first embodiment is eliminated. Since other components of the second embodiment are simply mirror images of the first embodiment, thus a detailed description thereof is omitted herein for the sake of brevity. As to its operation there is further provided a technique other than that described in the first embodiment. The additional technique is implemented substantially by rotating the external portion of the pawl 26 counterclockwise.

While the invention herein disclosed has been described by means of specific embodiments, numerous modifications and variations could be made thereto by those skilled in the art without departing from the scope and spirit of the invention set forth in the claims.

What is claimed is:

1. A rotary tape dispenser, comprising:

a container including a base, said base having an inlet, an outlet, and a pin projected inwardly from about a center of said base, said container further having a cover releasably secured to the base;

a circular rotary plate having a portion exposed at the inlet and including, at a side facing the cover, a plurality of cylinders disposed around a central hole thereof, and a plurality of pairs of adjacent guide posts along a periphery thereof, wherein a number of the pairs of adjacent guide posts is equal to a number of the cylinders;

a plurality of rolls of adhesive tapes, each roll being wound on a respective cylinders, each of the rolls of adhesive tapes having an open end pulled through a gap between each pair of guide posts; and a blade adjacent the outlet;

wherein in operation, the exposed portion of the rotary plate is rotated to turn the rolls of adhesive tapes until one of the rolls of adhesive tapes has turned to a position at the outlet, and the one roll of adhesive tape is pulled out of the outlet prior to being cut by the blade; and wherein the container further comprises an axial pawl on the pin, and the rotary plate further comprises a central sleeve projected inwardly from a periphery of the central hole, the central sleeve being put on the pin and an axial ratchet member inside the central sleeve being engaged with the axial pawl so that the rotation of the rotary plate is permitted only in a predetermined direction.

2. The rotary tape dispenser of claim 1, wherein the blade is disposed on a top of the outlet.

3. The rotary tape dispenser of claim 1, wherein the predetermined direction of the rotation of the rotary plate is counterclockwise.

4. The rotary tape dispenser of claim 1, wherein the ratchet member has a plurality of teeth, with each tooth having an arcuate long edge and a straight short edge for engaging with the axial pawl.

5. The rotary tape dispenser of claim 1, wherein the cylinders are equally spaced apart around a center of the rotary plate.

6. The rotary tape dispenser of claim 1, wherein the number of the cylinders is four.

7. The rotary tape dispenser of claim 1, wherein the number of the cylinders is three.

8. The A rotary tape dispenser comprising:

a container including a base, said base having an inlet, an outlet, and a pin projected inwardly from about a center of said base, said container further having a cover releasably secured to the base;

a circular rotary plate having a portion exposed at the inlet and including, at a side facing the cover, a plurality of cylinders disposed around a central hole thereof, and a plurality of pairs of adjacent guide posts along a periphery thereof, wherein a number of the pairs of adjacent guide posts is equal to a number of the cylinders;

a plurality of rolls of adhesive tapes, each roll being wound on a respective cylinder, each of the rolls of adhesive tapes having an open end pulled through a gap between each pair of guide posts; and a blade adjacent the outlet;

wherein in operation, the exposed portion of the rotary plate is rotated to turn the rolls of adhesive tapes until one of the rolls of adhesive tapes has turned to a position at the outlet, and the one roll of adhesive tape is pulled out of the outlet prior to being cut by the blade; and wherein the rotary plate further comprises a dust wall at the periphery and being sized to conform to the outlet.

9. A rotary tape dispenser comprising:

a container including a base, said base having an inlet, an outlet, and a pin projected inwardly from about a center of said base, said container further having a cover releasably secured to the base;

a circular rotary plate having a portion exposed at the inlet and including, at a side facing the cover, a plurality of cylinders disposed around a central hole thereof, and a plurality of pairs of adjacent guide posts along a periphery thereof, wherein a number of the pairs of adjacent guide posts is equal to a number of the cylinders;

a plurality of rolls of adhesive tapes, each roll being wound on a respective cylinder, each of the rolls of adhesive tapes having an open end pulled through a gap between each pair of guide posts; and a blade adjacent the outlet;

wherein in operation, the exposed portion of the rotary plate is rotated to turn the rolls of adhesive tapes until one of the rolls of adhesive tapes has turned to a position at the outlet, and the one roll of adhesive tape is pulled out of the outlet prior to being cut by the blade; and wherein the container further comprises an inwardly projected center sleeve and an axial ratchet member disposed on an inner surface of the center sleeve, and the rotary plate further comprises a central cylinder projected inwardly from a periphery of the central hole, and a central pawl extended outwardly from a bottom of the central cylinder that engages with one tooth of the ratchet member so that in operation, the central paw is rotated to turn the rolls of adhesive tapes in a predetermined direction until one of the rolls of adhesive tapes has turned to a the position at the outlet, and the one roll of adhesive tape is pulled out of the outlet prior to being cut by the blade.

10. The rotary tape dispenser of claim 9, wherein the predetermined direction of the rotation of the rotary plate is counterclockwise.

* * * * *